United States Patent [19]

Stewart et al.

[11] Patent Number: 4,869,060

[45] Date of Patent: Sep. 26, 1989

[54] FIBER OPENING DEVICES

[75] Inventors: William R. Stewart, Strathmartine; David B. Stewart, Angus; John Michael C. Dickinson, Fife, all of Scotland

[73] Assignee: Wm. R. Stewart & Sons (Hacklemakers) Limited, Dundee, Scotland

[21] Appl. No.: 209,730

[22] Filed: Jun. 22, 1988

[51] Int. Cl.[4] ..... D01H 7/895; D01H 7/888

[52] U.S. Cl. ..... 57/301; 19/105; 19/112; 57/304; 57/408; 57/411

[58] Field of Search ..... 19/97, 98, 109, 112, 19/200, 204, 205, 107, 85–87, 94; 57/300–302, 304, 408, 411

[56] References Cited

U.S. PATENT DOCUMENTS

| | | | |
|---|---|---|---|
| 3,626,681 | 12/1971 | Naruse | 57/411 |
| 3,681,907 | 8/1972 | Jindra et al. | 57/411 |
| 3,800,521 | 4/1974 | Doublesky et al. | 57/301 |
| 3,834,145 | 9/1974 | Ellingham et al. | 57/301 |
| 4,122,656 | 10/1978 | Shaw | 57/408 |
| 4,308,717 | 1/1982 | Onoue et al. | 57/301 |
| 4,512,060 | 4/1985 | Shofner | 19/200 |
| 4,631,781 | 12/1986 | Shofner | 19/112 X |
| 4,686,744 | 8/1987 | Shofner | 19/105 X |

FOREIGN PATENT DOCUMENTS

| | | |
|---|---|---|
| 1111549 | 7/1961 | Fed. Rep. of Germany . |
| 959560 | 6/1964 | United Kingdom . |
| 980989 | 1/1965 | United Kingdom . |
| 1449466 | 9/1976 | United Kingdom . |

OTHER PUBLICATIONS

Wilkinson & Moss, "Current Technology in Carding and Silver Preraration", pp. 2–10, Clemson University, 1977.

*Primary Examiner*—John Petrakes

*Attorney, Agent, or Firm*—Cushman, Darby & Cushman

[57] ABSTRACT

A cleaning system for use with a fibre opening device used in connection with the spinning of fibres into yarns wherein an opening roller is mounted for rotation in a housing incorporating a trash separation zone and a fibre stripping zone and the roller has a cylindrical working surface with combing elements projecting thereform, wherein the roller is substantially hollow and has holes in the cylindrical wall defining its working surface to permit flow of air through the wall and the interior of the roller is divided into two or more compartments, and means are provided to remove air and entrained dust and trash from a compartment adjacent to the trash separation zone, and further means are provided to insert air or other gas into a compartment adjacent the fibre stripping zone.

7 Claims, 3 Drawing Sheets

FIBER OPENING DEVICES

This invention relates to the spinning of fibres into yarns using discontinuous processes, and to a cleaning system for use with a fibre-opening device.

An open end spinning process involves presenting a sliver of fibres to an opening device which may consist of a conventional drafting system or incorporate a combing device with an opening roller with points or combing elements which may be integral with the working surface of the opening roller or be attached to the surface as for instance pins or card wire.

In the second case, the combing action of the points separates the individual fibres and also serves to liberate any adherant dust or trash from the fibres. A trash removal zone with or without one or more stripping edges may be provided to allow denser trash-particles to be separated from the fibre stream by centrifugal action.

The individual separated fibres are carried forward by the points of the opening roller and are stripped from the roller in a second zone with a further stripping edge where a fibre transfer tube serves to transport the individualised fibres to a yarn assembly device which may be e.g. a rotor or a friction roller device.

Conventionally, the transport of the fibres is further assisted by keeping the yarn assembly device at a lower pressure than that at the opening device.

Opening devices with facilities for separating trash can be open or closed. Open trash separation devices are kept open to the surrounding atmosphere with a separate mechanical or aspiration facility to remove the trash which accumulates, while closed devices are subjected to a separate source of suction or pressure to separate and/or remove the trash.

In either case, the pressure at the opening device is usually kept higher than the pressure at the spinning device.

Opening rollers, with pins, card wire or other forms of carding which also have perforations in the cylindrical wall defining the working surface connecting to the interior of the roller have surprisingly been found radically to improve the quality and regularity of the resultant spun yarn. It can be shown that there is an inflow of air into the interior of the opening roller with a consequent entrainment of lighter trash and dust because trash and dust are deposited in the inside of the roller. Removal of this dust and trash from the fibre stream contributes to a possible resultant improvement in the cleanliness of the yarn. A proportion of it is, however, carried forward to the fibre transfer tube through the hollow interior of the opening roller and incorporated into the yarn.

In order to reduce the amount of entrained dust and trash carried forward by the airstream and on into the spinning unit, means are required to separate the entrained dust and trash from the airstream.

It is, however, also thought that the balancing outflow of air through the holes in the surface of the roller in the region where the fibres are removed from the carding surface of the roller and moved into the fibre transport tube contributes to a better and less turbulent transfer and acceleration of the fibres and to a consequent improved evenness in the resultant yarn.

It is also believed that the outflow of air from the interior of the opening roller in the vicinity of the fibre stripping zone has the further advantage that it materially improves the release of fibres from the roller. As a result of this, with pinned opening rollers, it is possible to manufacture the opening roller with pins set at a more acute angle which contributes to better combing because of the better penetration of the pins into the fibre fringe at the feed roller. This also results in a significant improvement in pin life.

According to the present invention, we provide a fibre opening device for use with a discontinuous spinning unit comprising a housing in which an opening roller is mounted for rotation, the housing incorporating a trash separation zone and a fibre stripping zone, the roller having a cylindrical wall defining a working surface with combing elements projecting therefrom, said roller being substantially hollow and wherein holes are provided in the cylindrical wall to permit a flow of air through the wall, the hollow interior of the opening roller being separated into at least two compartments by means of walls which may be either fixed with respect to the opening roller or fixed with respect to the housing, means being provided to remove air and entrained dust and trash from a compartment adjacent to the trash separation zone of the housing, and further means being provided for inserting air or other gas into a compartment adjacent to the fibre stripping zone.

The means for removing the air and entrained dust and trash from the interior of the roller may be combined with the means for inserting the air or other gas and in that case the combined arrangement preferably has separation means incorporated to remove the entrained dust and trash from the airstream.

Alternatively, the two means may be entirely separate and indeed the volumes of air or gas involved need not be similar but may be optimised for the extraction of dust and trash and for the improvement and stabilisation of fibre transfer respectively.

In one construction, the hollow interior of the roller is divided into two compartments by a wall fixed to the housing. In an alternative construction, the interior of the roller is divided into two or more compartments by one or more walls within the roller.

Two preferred embodiments of fibre opening device according to the invention are now described by way of example with reference to the accompanying drawings, wherein.

Figure 1:
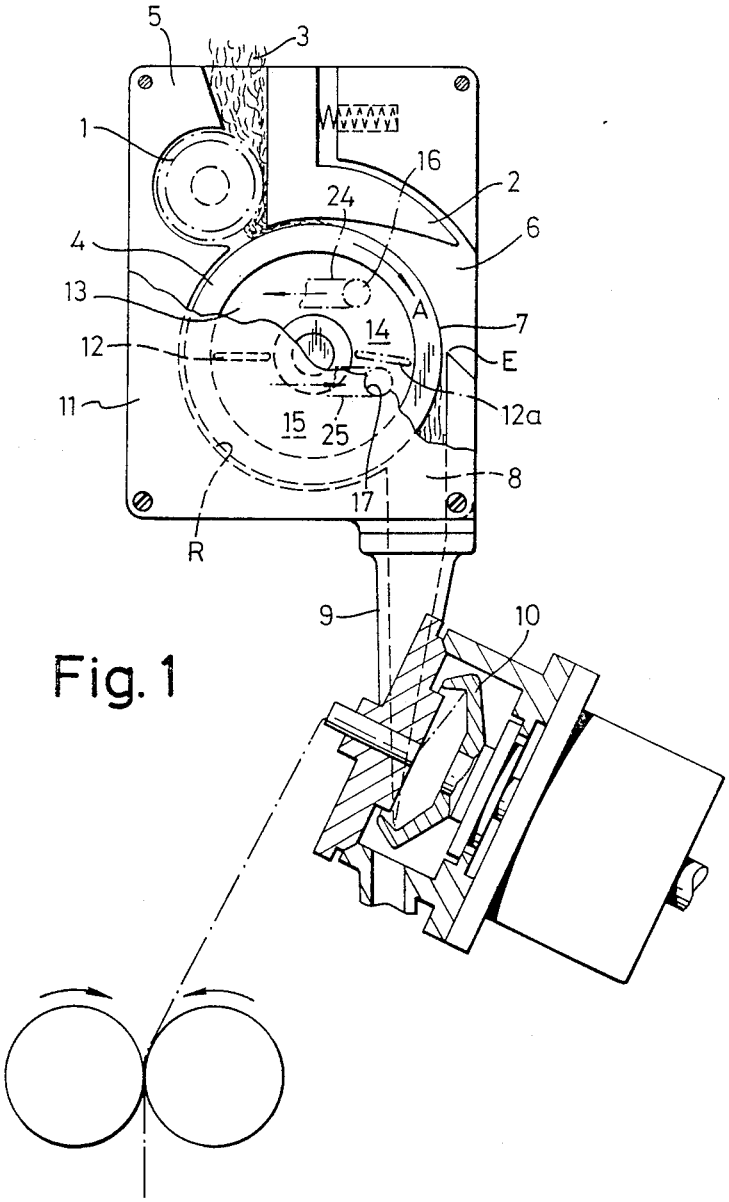
FIG. 1 is a partial, schematic view of a discontinuous spinning device wherein the internal volume of the opening roller is separated into two compartments by means of a separating wall fixed to the cover plate of a housing for the roller.

Referring to the drawings, FIG. 1 shows a discontinuous spinning unit comprising a feed roller 1 co-operating with a feed pedal 2 which presents a sliver of fibres 3 to a hollow, pinned opening roller 4 which is mounted in a fibre opening device 5 of the spinning unit for rotation in the direction of the arrow A.

A trash separation zone 6 in the opening device 5 is defined in part by a portion of a circumferential working surface 7 of the opening roller 4 and a fibre stripping zone 8 is provided some distance further round the circumferential working surface 7 of the opening roller 4, downstream of the zone 6. The trash separation zone 6 is open to the atmosphere while the fibre stripping zone 8 is connected by a fibre transfer tube 9 to a yarn assembly device 10 which is held at a lower pressure by internal or external pumping means (not shown). In fact, by using a certain type of stripping edge E for stripping the fibres from the roller 4 at the stripping zone 8, a compression area, i.e. a build up of pressure, is generated at the trash separation zone 6.

The individual fibres opened by the pinned roller 4 are transported round the cicumferential working surface 7 by pins 21 and stripped from them in the fibre stripping zone 8. From there, they are transported into the yarn assembly device 10 through the fibre transfer tube 9 by means of the airflow induced by the build up of pressure at the zone 8 or by internal or external pumping means (not shown).

The opening device 5 incorporates a recess R in which the roller 4 rotates and the open face of the roller 4 is effectively sealed off by a closely co-operating cover plate 11 (see FIG. 3) fixed to the opening device 5. The cover plate 11 has a pair of internal walls 12 and **12*a* which project into the hollow interior 13 of the opening roller 4 separating it into two compartments, 14 and 15. The cover plate 11 also has a pair of openings 16 and 17 therein connecting to the two compartments 14 and 15** permitting the inflow and outflow of air or other gases.

Figure 3:
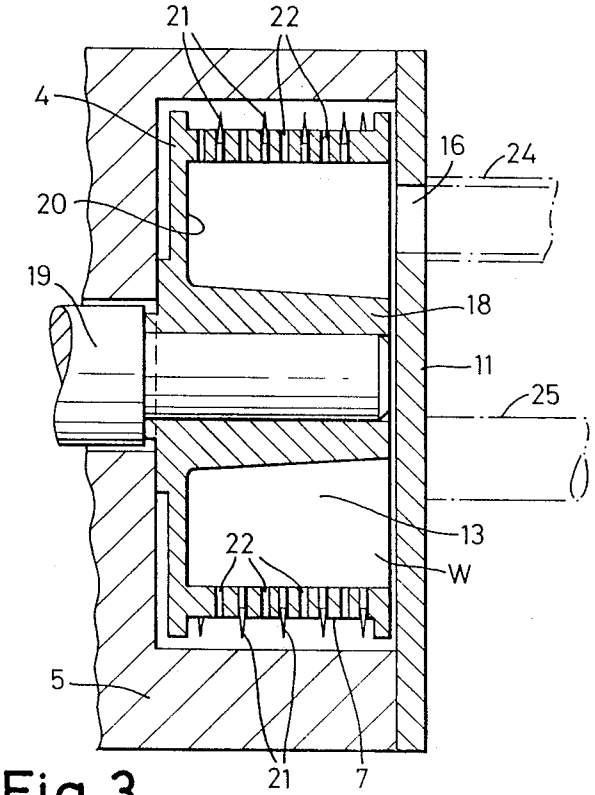
FIG. 3 is a diametral section of the pinned opening roller.
Figure 2:
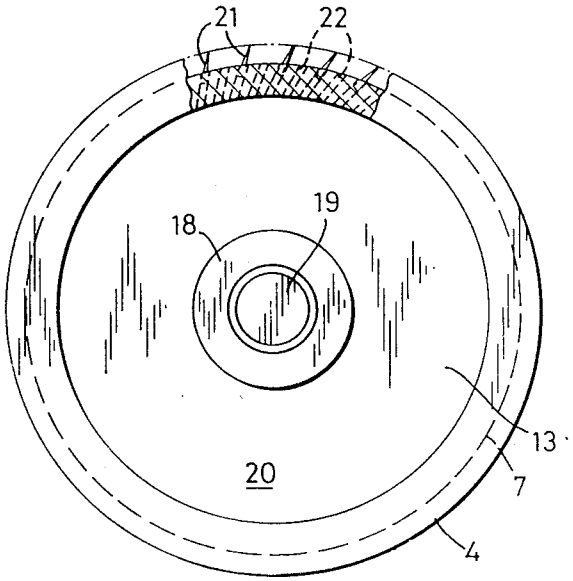
FIG. 2 is a side elevation of one embodiment of a pinned opening roller for use in the fibre opening device wherein the hollow interior of the opening roller is separated into two compartments by means of external walls.

Referring to FIGS. 2 and 3, the hollow interior 13 of the opening roller 4 is partly defined by a hub 18 by means of which the roller is mounted on a rotatable shaft 19. The hub 18 is connected by an integral radial end wall 20 to a cylindrical wall W concentric with the hub 18, the exterior face of which defines the cylindrical working surface 7 of the roller 4. A plurality of pins 21 project from the working surface 7, and a plurality of holes 22 which are interspersed with the pins 21 extend through the wall W and communicate with the hollow interior 13 of the roller 4 and permit the free flow of air into and out of the interior of the roller 4.

The opening 16 in the cover plate 11 is connected to a transfer tube 24 which in turn is connected to means (not shown) provided to remove air and entrained dust and trash from the compartment 14 adjacent to the opening 16. The second opening 17 in the cover plate 11 is connected to a second transfer tube 25 which in turn is connected to other means (not shown) provided for inserting air or other gas into the compartment 15 adjacent to the opening 17.

Figure 4:
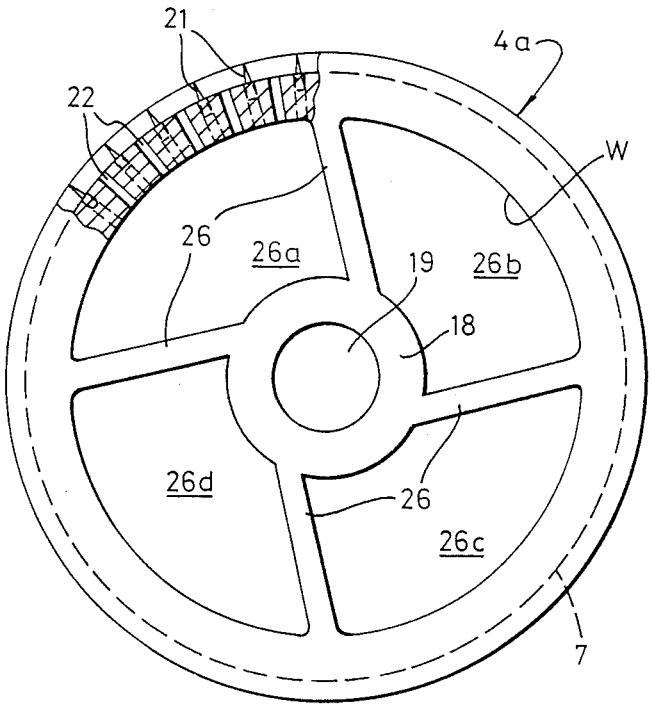
FIG. 4 is a side elevation of a second embodiment of a pinned opening roller for use in the fibre opening device wherein the hollow interior of the opening roller is separated into a number of compartments by means of integral walls.

FIG. 4 shows another embodiment of opening roller **4*a* in which parts similar to the previous embodiment are identified with the same reference numerals. The hub 18 is connected by four equi-spaced septal walls 26 to the wall W defining the concentric cylindrical working surface 7, thus forming a series of separate interior compartments 26*a*, 26*b*, 26*c*, 26*d*. In other respects, the roller 4*a*** is similar to that of the previous embodiment.

The opening 16 is located near the trash separation zone 6 and due to its connection to a device for removing air and entrained dust and trash by the tube 24, a pressure differential is generatd between the trash separation zone 6 and the hollow interior 13 in the case of the roller 4, or the individual separate interior compartments **26*a*, 26*b*, 26*c*, 26*d* of the roller 4*a*. In other words, air and entrained dust and trash are moved from the trash separation zone 6 through the holes 22 in the surface 7 and into the hollow interior 13 or the individual interior compartments respectively, while they are opposite the trash separation zone 6. The tube 24** is connected to some form of extractor device to remove the air and entrained dust and trash from within the roller.

Due to the second opening 17, which is adjacent to the fibre stripping zone 8, being connected by the transfer tube 25 to an external device for inserting clean air or gas (not shown), a pressure differential is generated between the hollow interior 13 of the roller 4, or the adjacent interior compartment of the roller **4*a*, and the fibre stripping zone 8**, to assist with stripping fibres from the roller.

Although it is preferred that the pressure differentials are generated by one or more external devices, they could be generated by internal pumping means, or by external pumping means (not shown) connected to the yarn assembly device 10. The pressure differentials cause an inflow of air or gas into the opening roller 4 through the transfer tube 24 and the opening 16 in the region of the zone 6 and outflow of air or gas through the holes 22 in the roller 4 in the region of the fibre stripping zone 8.

Throughout the specification, reference has been made to holes in the wall of the opening roller, and these have been specifically described as holes 22 which are distinct from the pins 21. It will be appreciated, however, that instead of locating round shanked pins 21 with a tight fit in round holes in the wall of the roller, and drilling separate holes 22, the pins could have shanks which do not match their locating holes in the wall of the roller, thus leaving one or more holes around the pin shanks. In this case, separate holes 22 may not be necessary, and the term holes should therefore be interpreted accordingly.

It will of course be understood that the present invention has been described above purely by way of example, and modifications of detail can be made within the scope of the invention.

We claim:

1. A fibre opening device for use with a discontinuous spinning unit comprising:

a housing, the housing incorporating a trash separation zone and a fibre stripping zone;

an opening roller, said opening roller being mounted for rotation within said housing, the roller having a cylindrical wall defining a working surface with combing elements projecting therefrom, said roller being substantially hollow and wherein holes are provided in the cylindrical wall to permit a flow of air through the wall, the hollow interior of the opening roller being separated into at least two compartments;

first means being provided for removing air and entrained dust and trash from one of said compartments adjacent to the trash separation zone of the housing; and further means being provided for inserting air or other gas into one of said compartments adjacent to the fibre stripping zone.

2. A fibre opening device according to claim 1 wherein a cover plate forms part of the housing for the roller, the first means for removing the air and entrained dust and trash from the interior of the roller comprising an opening in said cover plate, the opening being located adjacent to the trash separation zone, external means are provided for drawing air, trash and dust from within the roller, said opening being connected to said external means, and the means for inserting air or other gas into the roller comprises a further opening in the cover plate adjacent to the stripping zone, and wherein a source of air or gas is provided, said further opening being connected to the source of air or gas.

3. A fibre opening device according to claim 1 or 2 wherein a separation means is provided to remove trash, dust and other unwanted material from the air extracted from within the roller, said first means being connected to said separation means, said air then being transferred to said further means.

4. A fibre opening device according to claim 3 wherein there are two compartments and a wall is fixed to the housing so as to divide the hollow interior of the roller into the two compartments.

5. The fibre opening device according claim 3 wherein at least one wall is defined within the roller so that the interior of the roller is divided into said at least two compartments.

6. A fibre opening device according to claim 1 or 2 wherein there are two compartments and a wall is fixed to the housing so as to divide the hollow interior of the roller into the two compartments.

7. A fibre opening device according to claim 1 or 2 wherein at least one wall is defined within the roller so that the interior of the roller is divided into said at least two compartments.

* * * * *